US011180917B2

(12) United States Patent
Qin

(10) Patent No.: US 11,180,917 B2
(45) Date of Patent: Nov. 23, 2021

(54) STRUCTURE AND METHOD FOR CONNECTING A COMPOSITE INSULATION EXTERIOR WALL PANEL AND A STEEL STRUCTURAL BEAM-COLUMN

(71) Applicants: Hebei Huiyuan Building Materials Co., Ltd, Chengde (CN); Chifeng Huiyuan Building Materials Co., Ltd, Inner Mongolia Autonomous Region (CN)

(72) Inventor: Haishan Qin, Chengde (CN)

(73) Assignees: HEBEI HUIYUAN BUILDING MATERIALS CO., LTD, Chengde (CN); CHIFENG HUIYUAN BUILDING MATERIALS CO.. LTD, Inner Mongolia Autonomous Region (CN)

( * ) Notice: Subject to any disclaimer, the term of this patent is extended or adjusted under 35 U.S.C. 154(b) by 258 days.

(21) Appl. No.: 16/688,206

(22) Filed: Nov. 19, 2019

(65) Prior Publication Data

US 2020/0157813 A1 May 21, 2020

(30) Foreign Application Priority Data

Nov. 20, 2018 (CN) ..... 201811407484.6

(51) Int. Cl.
*E04B 1/12* (2006.01)
*E04B 2/04* (2006.01)
(Continued)

(52) U.S. Cl.
CPC ..... *E04C 2/284* (2013.01); *E04B 1/40* (2013.01); *E04B 1/80* (2013.01); *E04B 1/942* (2013.01);
(Continued)

(58) Field of Classification Search
CPC . E04C 2/284; E04C 2/205; E04C 2/46; E04C 2/50; E04B 1/40; E04B 1/80;
(Continued)

(56) References Cited

U.S. PATENT DOCUMENTS 1,858,715 A * 5/1932 Mckay ..... E04B 9/22 52/359
1,997,809 A * 4/1935 Cole ..... E04B 1/24 52/281
2,027,882 A * 1/1936 Ross ..... E04B 2/58 52/506.08
(Continued)

*Primary Examiner* — Phi D A
(74) *Attorney, Agent, or Firm* — Tutunjan & Bitetto, P.C.

(57) ABSTRACT

The present invention discloses a structure for connecting a composite insulation exterior wall panel and a steel structural beam-column, including a steel structural beam and a steel structural column making up a a steel structural body. A filling insulation layer is provided at a gap of the steel structural body. A composite insulation panel connecting assembly is wrapped at a junction between the steel structural beam and the steel structural column. The composite insulation panel connecting assembly is connected to a horizontal composite insulation panel assembly, via a staggered seam, in a horizontal direction, and the composite insulation panel connecting assembly is connected to a vertical composite insulation panel assembly, via a staggered seam, in a vertical direction.

16 Claims, 6 Drawing Sheets

(51) Int. Cl.

| | |
|---|---|
| ***E04B 2/46*** | (2006.01) |
| ***E04C 2/284*** | (2006.01) |
| ***E04B 1/41*** | (2006.01) |
| ***E04B 1/80*** | (2006.01) |
| ***E04B 1/94*** | (2006.01) |
| *E04C 2/20* | (2006.01) |

(52) U.S. Cl.
CPC . *E04B 1/12* (2013.01); *E04B 2/04* (2013.01); *E04C 2/205* (2013.01)

(58) Field of Classification Search
CPC ... E04B 1/762; E04B 1/38; E04B 1/76; E04B 2/00; E04B 2/90; E04B 7/22; E04B 1/12; E04B 5/023; E04B 2002/0247
See application file for complete search history.

(56) References Cited

U.S. PATENT DOCUMENTS 2,160,225 A * 5/1939 Newman ..... E04B 2/62 52/293.3
2,193,550 A * 3/1940 Coe, Jr. ..... E04B 1/26 52/293.3
2,366,108 A * 12/1944 Hitchins ..... E04B 1/30 52/298
2,970,676 A * 2/1961 Maciunas ..... E04B 1/24 52/207
3,593,477 A * 7/1971 Briggs ..... E04B 1/185 52/253
4,320,604 A * 3/1982 O'Hanlon ..... E04B 1/80 52/169.11
4,342,177 A * 8/1982 Smith ..... E04C 3/40 52/93.1
4,573,292 A * 3/1986 Kaufman ..... E04B 1/34336 52/125.2
5,704,174 A * 1/1998 Dal Lago ..... E04B 1/20 52/220.5
5,782,047 A * 7/1998 De Quesada ..... E04C 2/384 52/236.6
6,625,943 B1 * 9/2003 Renner ..... E04B 1/165 52/250
8,327,593 B2 * 12/2012 Laprise ..... E04B 1/6108 52/309.7
8,959,867 B2 * 2/2015 Schold ..... E04B 1/19 52/650.1
2004/0040234 A1 * 3/2004 Davison ..... E04B 5/10 52/270
2013/0104472 A1 * 5/2013 Carolan ..... E04F 13/0819 52/204.1
2017/0002579 A1 * 1/2017 French ..... E04C 2/523
2018/0328019 A1 * 11/2018 Collins ..... E04B 1/40

* cited by examiner

STRUCTURE AND METHOD FOR CONNECTING A COMPOSITE INSULATION EXTERIOR WALL PANEL AND A STEEL STRUCTURAL BEAM-COLUMN

TECHNICAL FIELD

The present invention relates to the technical field of integration of steel structure and wall insulation, and in particular to a structure and method for connecting a composite insulation exterior wall panel and a steel structural beam-column.

BACKGROUND

Along with continuous improvement of a building energy-saving standard and continuous development of a building industry in China, in recent years, relevant enterprises have made many beneficial attempts in aspects of prefabricated building, and integration of building structure and insulation, and researched a series of external wall insulation panels. However, the existing external wall insulation panel generally cannot achieve a very good insulation effect, and cannot realize wall insulated integration. Particularly, an external wall board assorted with a steel structure generally has a poor insulation performance. Moreover, due to large deformation of the steel structure, a junction between a board material and a structural main body is cracked easily. In order to solve the above technical problems, there is an urgent need to provide a structure and method for connecting a composite insulation exterior wall panel and a steel structural beam-column, to implement flexible connection between a composite insulation exterior wall panel and a steel structure, and simultaneously improve the insulation performance of a wall.

SUMMARY

An objective of the present invention is to provide a structure and method for connecting a composite insulation exterior wall panel and a steel structural beam-column, to solve the problems of the above prior art. An inside and an outside of a steel structural body are connected to an insulation panel to implement flexible connection; and composite insulation exterior wall panels are connected via a convex-concave staggered seam to prevent a continuous seam and improve the insulation effect.

To achieve the above purpose, the present invention provides the following technical solutions: The present invention provides a structure for connecting a composite insulation exterior wall panel and a steel structural beam-column, including a steel structural beam and a steel structural column, where the steel structural beam and the steel structural column respectively include a steel structural body; a filling insulation layer is provided at a gap of the steel structural body; when the steel structural beam and the steel structural column are in cross-shaped connection, a first composite insulation panel connecting assembly is wrapped at a junction between the steel structural beam and the steel structural column; when the steel structural beam and the steel structural column are in L-shaped connection for corner connection, a second composite insulation panel connecting assembly is wrapped at a junction between the steel structural beam and the steel structural column; the first composite insulation panel connecting assembly and the second composite insulation panel connecting assembly are respectively connected to a horizontal composite insulation panel assembly, via a staggered seam, in a horizontal direction, for wrapping the steel structural beam; the first composite insulation panel connecting assembly and the second composite insulation panel connecting assembly are respectively connected to a vertical insulation panel assembly, via a staggered seam, in a vertical direction, for wrapping the steel structural column; and the horizontal composite insulation panel assembly and the vertical composite insulation panel assembly are connected to a composite insulation exterior wall panel via a staggered seam to form a composite insulation exterior wall panel whole without a continuous seam.

Preferably, the first composite insulation panel connecting assembly, the second composite insulation panel connecting assembly, the horizontal composite insulation panel assembly, the vertical composite insulation panel assembly and the composite insulation exterior wall panel respectively includes a composite insulation panel body; the composite insulation panel body includes an insulation panel, a fireproof flame-retardant board and a steel wire net; a layer of the fireproof flame-retardant board is respectively disposed on two sides of the insulation panel; and a layer of the steel wire net is respectively disposed outside the fireproof flame-retardant boards on the two sides.

Preferably, the steel wire net is fixed outside the fireproof flame-retardant board via a web wire strip; one end of the web wire strip is welded with the steel wire net, and the other end of the web wire strip passes through the fireproof flame-retardant board and is stretched into the insulation panel but not inserted through the insulation panel.

Preferably, a non-metallic connecting piece is further disposed in the composite insulation panel body; the non-metallic connecting piece is penetrated through the composite insulation panel body; and two ends of the non-metallic connecting piece are respectively and fixedly connected to the steel wire nets on the two sides.

Preferably, one side, close to the junction between the steel structural beam and the steel structural column, of the insulation panel body of the first composite insulation panel connecting assembly is provided with a cross-shaped groove, the junction between the steel structural beam and the steel structural column is mounted in the cross-shaped groove, and the steel structural beam and the steel structural column are protruded out of the cross-shaped groove; and one side, close to the junction between the steel structural beam and the steel structural column, of the insulation panel body of the second composite insulation panel connecting assembly is provided with a T-shaped groove, the junction between the steel structural beam and the steel structural column is mounted in the T-shaped groove, and the steel structural beam and the steel structural column are protruded out of the T-shaped groove;

one side, close to the steel structural beam, of the insulation panel body of the horizontal composite insulation panel assembly is provided with a horizontal groove; one side, close to the steel structural column, of the insulation panel body of the vertical composite insulation panel assembly is provided with a vertical groove; and the steel structural beam and the steel structural columns are respectively disposed in the horizontal groove and the vertical groove, and are protruded out of the horizontal groove and the vertical groove; and the cross-shaped groove, the T-shaped groove, the horizontal groove and the vertical grooves are located on a same side.

Preferably, the fireproof flame-retardant board is further fixed on a front side and a lateral side of a protruded portion of each of the steel structural beam and the steel structural column via a steel wire connecting net; and two sides of the steel wire connecting net are respectively connected a steel wire net outside an adjacent insulation panel body.

Preferably, multiple steel reinforcing rods are further respectively welded on two sides of a steel structural body of the protruded portion of each of the steel structural beam and the steel structural column; and certain ends, far away from the steel structural body, of the steel reinforcing rods are connected to the adjacent steel wire net.

Preferably, an adjacent junction between the first composite insulation panel connecting assembly, the second composite insulation panel connecting assembly, the horizontal composite insulation panel assembly, the vertical composite insulation panel assembly and the composite insulation exterior wall panel is connected via a staggered seam; the staggered seam connection includes a protruded portion or a groove notch portion; and a thickness of the protruded portion or the groove notch portion is 2-10 cm.

Preferably, the insulation panel layer, and the filling insulation layer in the gap of the steel structural body use a polystyrene board, a polyurethane board, a graphite polystyrene board or an extruded sheet, etc.; and the fireproof flame-retardant board uses a perlite board and the like.

The present invention further provides a method for connecting a composite insulation exterior wall panel and a steel structural beam-column, including the following steps when a composite insulation panel assembly, a connecting assembly and a composite insulation panel body produced in a factory are transported to a construction site for fabricated assembly:

1) filling an insulation layer in a gap of a steel structural body;

2) connecting a first composite insulation panel connecting assembly and a second composite insulation panel connecting assembly to steel structural beam and column;

3) respectively connecting a horizontal composite insulation panel assembly and a vertical composite insulation panel assembly to the steel structural beam and the steel structural column;

4) connecting multiple composite insulation exterior wall panels between the horizontal composite insulation panel assembly and the vertical composite insulation panel assembly via a convex-concave staggered seam to form a whole without a continuous seam;

5) respectively welding multiple steel reinforcing rods on two sides of a steel structural body of a protruded portion of each of the steel structural beam and the steel structural column and connecting the steel reinforcing rods to a steel wire net;

6) fixing a fireproof flame-retardant board on a front side and a lateral side of the protruded portion of each of the steel structural beam and the steel structural column via a steel wire connecting net, where the steel wire connecting net is disposed on an outer layer of the fireproof board, and is connected to a steel wire net outside an adjacent composite insulation panel body;

7) placing a steel wire connecting net at a seam of various composite insulation panel assemblies, the connecting assemblies and the composite insulation exterior wall panels; and 8) spraying and plastering a cement mortar on a steel wire net outside the composite insulation exterior wall panel to form a composite insulated wall Compared with the prior art, the present invention achieves the following technical effects:

In the present invention, an inside and an outside of a steel structural body are connected to an insulation layer to implement flexible connection and prevent a junction from cracking; and composite insulated wall boards are connected via a staggered seam to eliminate a continuous seam and improve the insulation effect.

BRIEF DESCRIPTION OF THE DRAWINGS

To describe the technical solutions in the embodiments of the present invention or in the prior art more clearly, the following briefly describes the accompanying drawings required for describing the embodiments. Apparently, the accompanying drawings in the following description show some embodiments of the present invention, and a person of ordinary skill in the art may still derive other drawings from these accompanying drawings without creative efforts.

Figure 1:
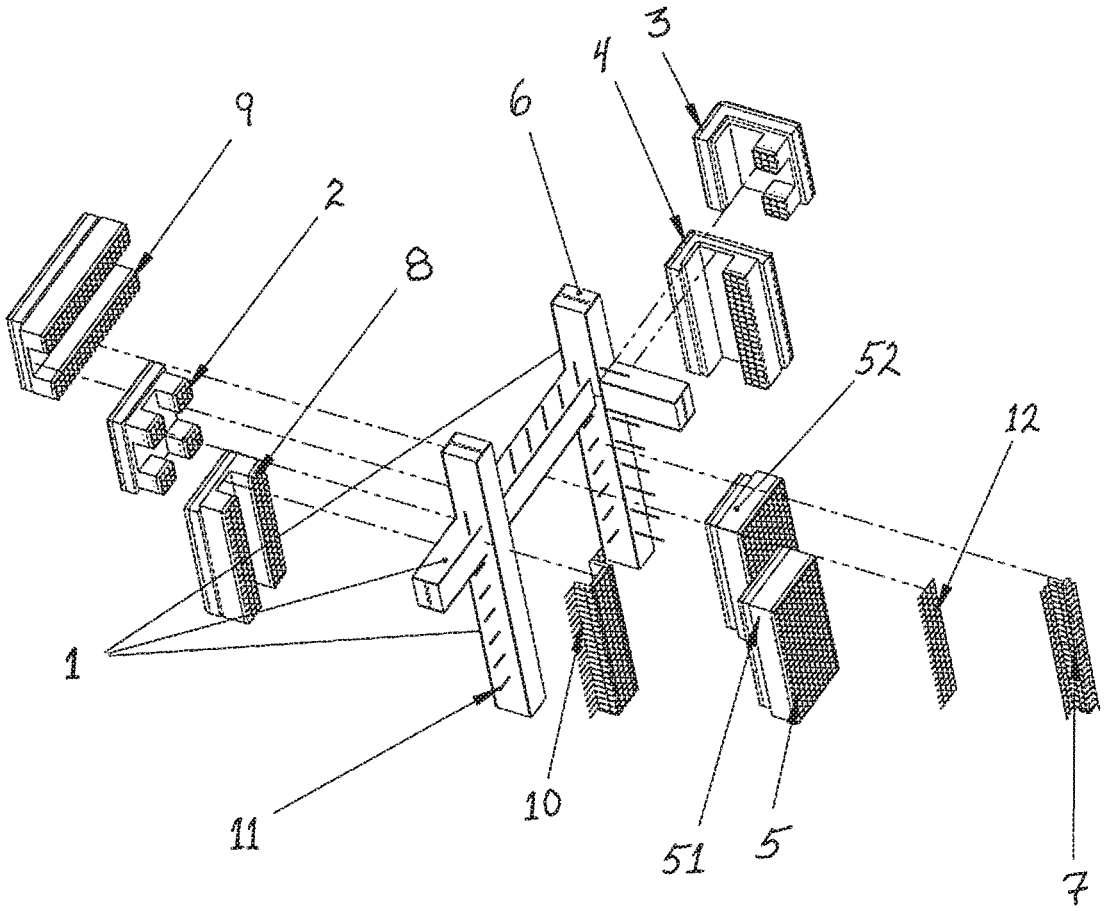
FIG. 1 is an exploded structural schematic diagram of a structure for connecting a composite insulation exterior wall panel and a steel structural beam-column according to an embodiment of the invention.
Figure 2:
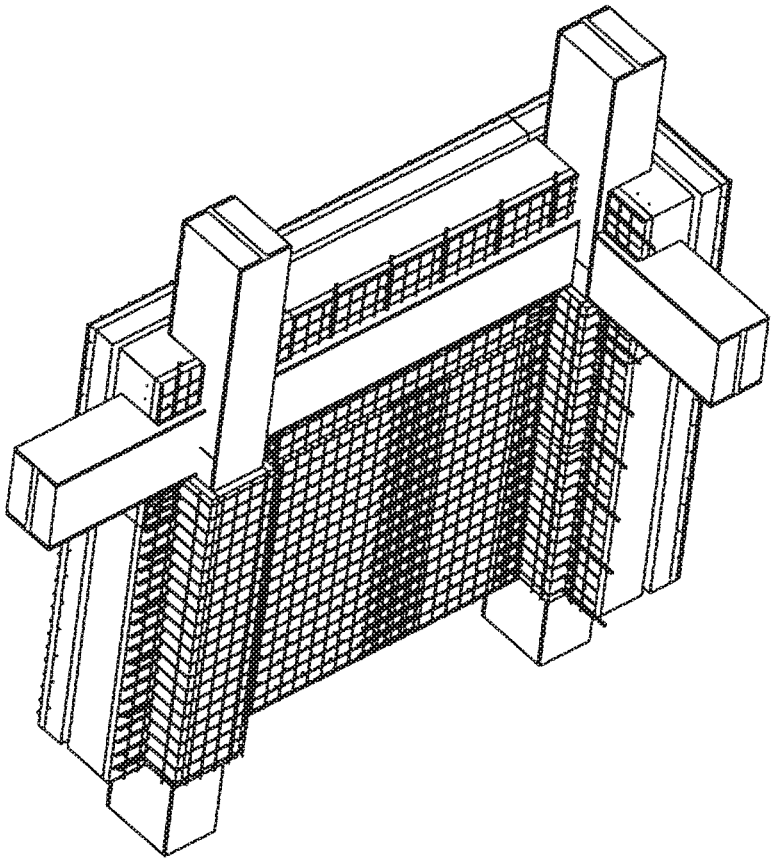
FIG. 2 is a structural schematic diagram of a structure for connecting a composite insulation exterior wall panel and a steel structural beam-column according to an embodiment of the invention.

In the figures, the following is a list of parts and reference numerals: steel structural beam and column 1; first composite insulation panel connecting assembly 2; second composite insulation panel connecting assembly 3; corner vertical composite insulation panel assembly 4; composite insulation exterior wall panel 5; filling insulation layer 6; composite insulation exterior wall panel I 51; composite insulation exterior wall panel II 52; insulation panel 53; steel wire net 54; fireproof flame-retardant board 55; corner type steel wire connecting net 7; vertical composite insulation panel assembly 8; horizontal composite insulation panel assembly 9; omega-shaped steel wire connecting net 10; steel reinforcing rod 11; steel wire connecting net 12; protruded portion 13; and groove notch portion 14.

DETAILED DESCRIPTION

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

An objective of the present invention is to provide a structure and method for connecting a composite insulation exterior wall panel and a steel structural beam-column, to solve the above discussed problems of the prior art. An inside and an outside of a steel structural body are connected to an insulation layer to implement flexible connection and prevent a junction from cracking. The composite insulation exterior wall panels are connected via a staggered seam to eliminate a continuous seam and improve the insulation effect.

To make the foregoing objective, features, and advantages of the present invention clearer and more comprehensible, the present invention is further described in detail below with reference to the accompanying drawings and specific embodiments.

Embodiment 1

As shown in FIGS. 1-8, this embodiment provides a composite insulation exterior wall panel 5 and steel structural beam-column connecting structure, which includes a steel structural beam and a steel structural column. The steel structural beam and the steel structural column respectively include a steel structural body. A filling insulation layer 6 is provided at a gap of the steel structural body. When the steel structural beam and the steel structural column are connected in a cross-shaped structure, a first composite insulation panel connecting assembly 2 is wrapped at a junction between the steel structural beam and the steel structural column, and when the steel structural beam and the steel structural column are in an L-shaped connection (connection at a corner), a second composite insulation panel connecting assembly 3 is wrapped at a junction between the steel structural beam and the steel structural column.

The first composite insulation panel connecting assembly 2 and the second composite insulation panel connecting assembly 3 are respectively connected to a horizontal composite insulation panel assembly 9, via a staggered seam, in a horizontal direction, for wrapping the steel structural beam. The first composite insulation panel connecting assembly 2 and the second composite insulation panel connecting assembly 3 are respectively connected to a vertical insulation panel assembly, via a staggered seam, in a vertical direction, for wrapping the steel structural column. The number of the horizontal composite insulation panel assemblies 9 and the vertical composite insulation panel assemblies 8 may be selected according to a specific dimension of a wall. Multiple composite insulation exterior wall panels 5 are connected between the first composite insulation panel connecting assembly 2, the second composite insulation panel connecting assembly 3, the horizontal insulation panel assembly 9, and the vertical insulation panel assembly 8 via a convex-concave staggered seam to form a whole without a continuous seam.

Figure 3A:
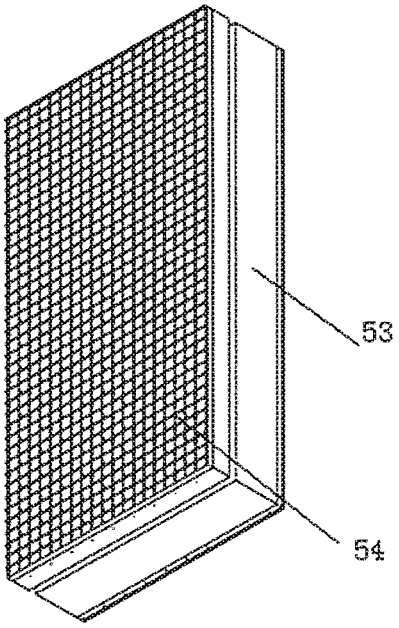
FIGS. 3*a*-3*c* are structural schematic diagrams of a composite insulation panel body according to an embodiment of the invention.
Figure 3B:
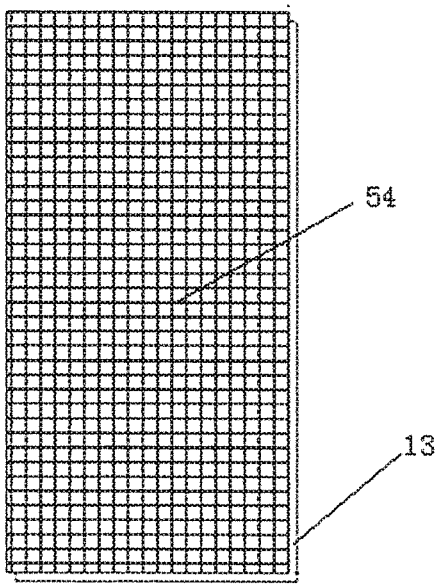

Specifically, in this embodiment, the composite insulation panel connecting assembly 2, the second composite insulation panel connecting assembly 3, the horizontal composite insulation panel assembly 9, the vertical composite insulation panel assembly 8 and the composite insulation exterior wall panel 5 respectively include an insulation panel body. A thickness of each insulation panel body is the same, thereby guaranteeing that the flat composite insulation exterior wall panel 5 can be formed. The composite insulation panel body includes an insulation panel 53 (See, e.g., FIGS. 3*a* and 3*c*), a fireproof flame-retardant board 55 (See, e.g., FIG. 3*c*) and a steel wire net 54 (FIG. 3*b*). A layer of the fireproof flame-retardant board 55 is respectively disposed on two sides of the insulation panel. A layer of the steel wire net 54 is respectively disposed outside the fireproof flame-retardant boards 55 on the two sides. A backing strip is further disposed between the steel wire net 54 and the fireproof flame-retardant board 55 to keep a certain distance therebetween. The insulation panel layer uses a polystyrene board, a polyurethane board, a graphite polystyrene board or an extruded sheet, etc. The fireproof flame-retardant board 55 uses a perlite board and the like, and preferably uses an expanded perlite board. Thicknesses of the insulation panel 53 and the fireproof flame-retardant board 55 may be selected as required and may be 10-30 cm and 2-5 cm respectively.

The steel wire net 54 is fixed outside the fireproof flame-retardant board 55 via a web wire strip (not shown). One end of the web wire strip is welded with the steel wire net 54, and the other end of the web wire strip passes through the fireproof flame-retardant board 55 and is stretched into the insulation panel but not inserted through the insulation panel. A steel wire of the steel wire net 54 and the web wire strip all are a zinc-wrapped steel wire having a diameter of 2-3 mm. A non-metallic connecting piece is further disposed in the composite insulation panel body. The non-metallic connecting piece is penetrated through the composite insulation panel body. Two ends of the non-metallic connecting piece are respectively and fixedly connected to the steel wire nets 54 on the two sides. With the non-metallic connecting piece, the overall strength of the composite insulated wall board is further improved.

One side of the insulation panel body of each of the first composite insulation panel connecting assembly 2 and the second composite insulation panel connecting assembly 3, close to the junction between the steel structural beam and the steel structural column, is provided with a cross-shaped groove or a T-shaped groove. The junction between the steel structural beam and the steel structural column is mounted in the cross-shaped groove or the T-shaped groove, and the steel structural beam and the steel structural column are protruded out of the cross-shaped groove or the T-shaped groove. One side of the insulation panel body of the horizontal composite insulation panel assembly 9, close to the steel structural beam, is provided with a horizontal groove. One side of the insulation panel body of the vertical insulation panel assembly 8, close to the steel structural column, is provided with a vertical groove, and the steel structural beam and the steel structural columns are respectively disposed in the horizontal groove and the vertical groove, and are protruded out of the horizontal groove and the vertical groove. The cross-shaped groove, the T-shaped groove, the horizontal groove and the vertical grooves are located on a same side. With the cooperation of the multiple grooves, the insulation panel completely wraps the steel structural column and the steel structural beam to guarantee the insulation effect.

Specifically, a cross-sectional shape of the cross-shaped groove, the T-shaped groove, the horizontal groove and the vertical groove may be selected according to a shape of the steel structural beam and the steel structural column. In this embodiment, the steel structural beam and the steel structural column are of a cuboid structure respectively, and each groove is also of a matched cuboid structure.

Further, the fireproof flame-retardant board 55 is further fixed on a front side and a lateral side of a protruded portion of each of the steel structural beam and the steel structural column via an omega-shaped steel wire connecting net 10 or a corner type steel wire connecting net 7. The omega-shaped steel wire connecting net 10 or the corner type steel wire connecting net 7 is located outside the fireproof flame-retardant board 55, with two sides respectively connected to the adjacent steel wire net 54. Multiple steel reinforcing rods 11 are further respectively welded on two sides of a steel structural body of the protruded portion of each of the steel structural beam and the steel structural column. Certain ends of the steel reinforcing rods 11, far away from the steel structural body, are connected to the adjacent steel wire net 54. With the further fixation of the steel reinforcing rods 11, the connecting effect is improved.

Figure 3C:
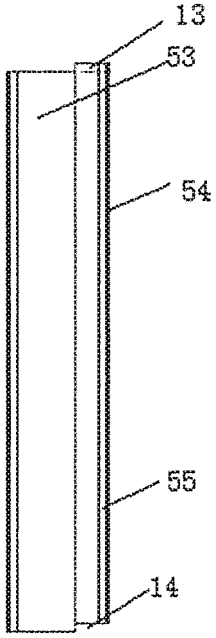
Figure 4:
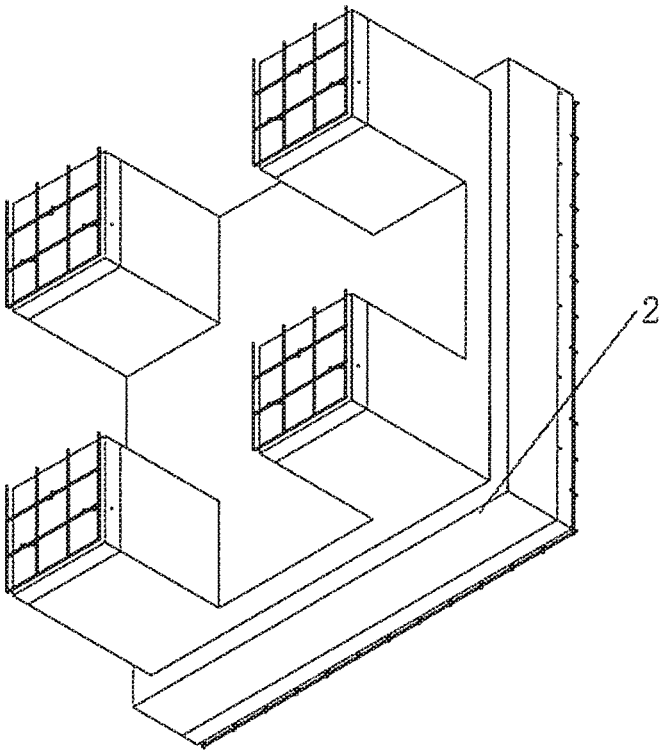
FIG. 4 is a structural schematic diagram of a first composite insulation panel connecting assembly according to an embodiment of the invention.
Figure 5:
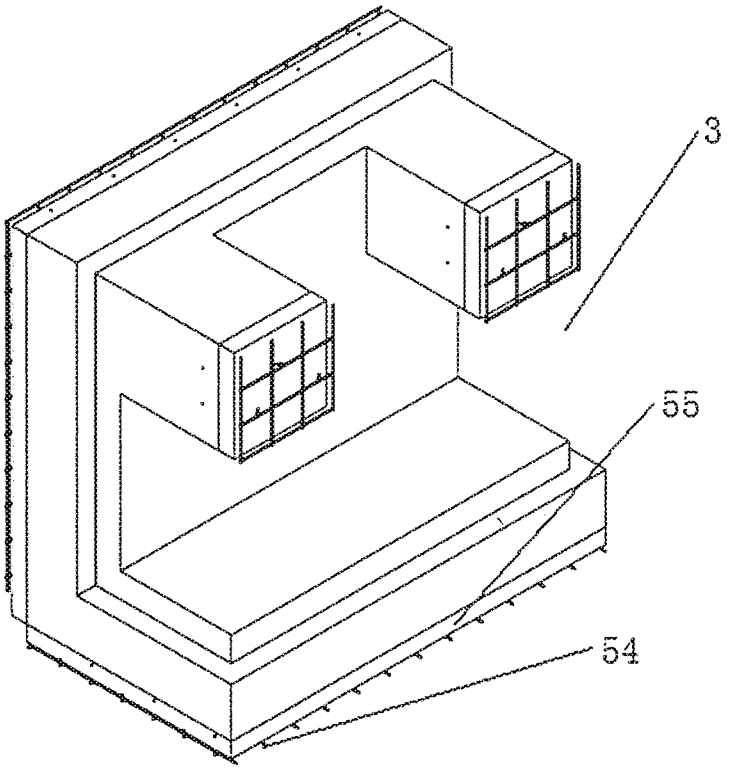
FIG. 5 is a structural schematic diagram of a second composite insulation panel connecting assembly according to an embodiment of the invention.
Figure 6:
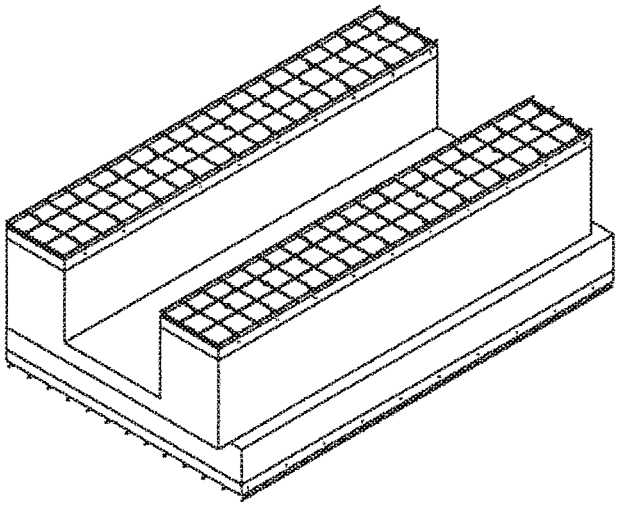
FIG. 6 is a structural schematic diagram of a horizontal composite insulation panel assembly and a vertical composite insulation panel assembly according to an embodiment of the invention.
Figure 7:
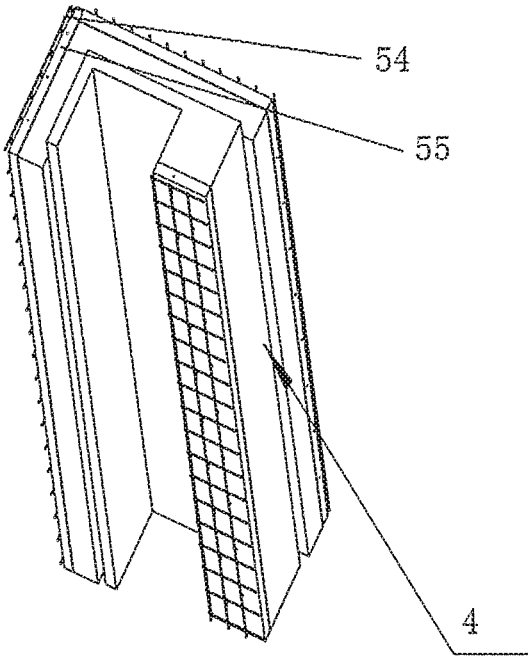
FIG. 7 is a structural schematic diagram of a corner vertical composite insulation panel assembly according to an embodiment of the invention.
Figure 8A:
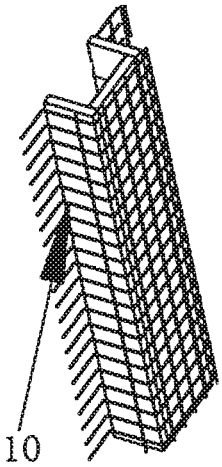
FIGS. 8*a*-8*c* are structural schematic diagrams of a steel wire connecting net according to an embodiment of the invention.
Figure 8B:
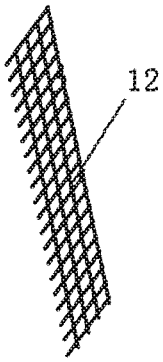
Figure 8C:
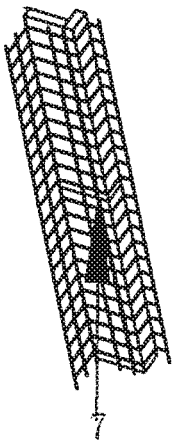

In this embodiment, an adjacent junction between the first composite insulation panel connecting assembly 2, the second composite insulation panel connecting assembly 3, the horizontal composite insulation panel assembly 9, the vertical composite insulation panel assembly 8 and the composite insulation exterior wall panel 5 is connected via a staggered seam. The staggered seam connection includes a protruded portion 13 or a groove notch portion 14 (FIG. 3*c*). A thickness of the protruded portion 13 or the groove notch portion 14 is 2-10 cm, and preferably is 3 cm. With the connection via the staggered seam, a continuous seam is eliminated to reduce the heat loss and improve the insulation effect. A specific position of the protruded portion 13 or the groove notch portion 14 may be selected as required provided that the continuous seam can be eliminated.

In this embodiment, a connecting method for the structure for connecting a composite insulation exterior wall panel and a steel structural beam-column includes the following steps when a composite insulation panel assembly, a connecting assembly and a composite insulation panel body produced in a factory are transported to a construction site for fabricated assembly.

Figure 9:
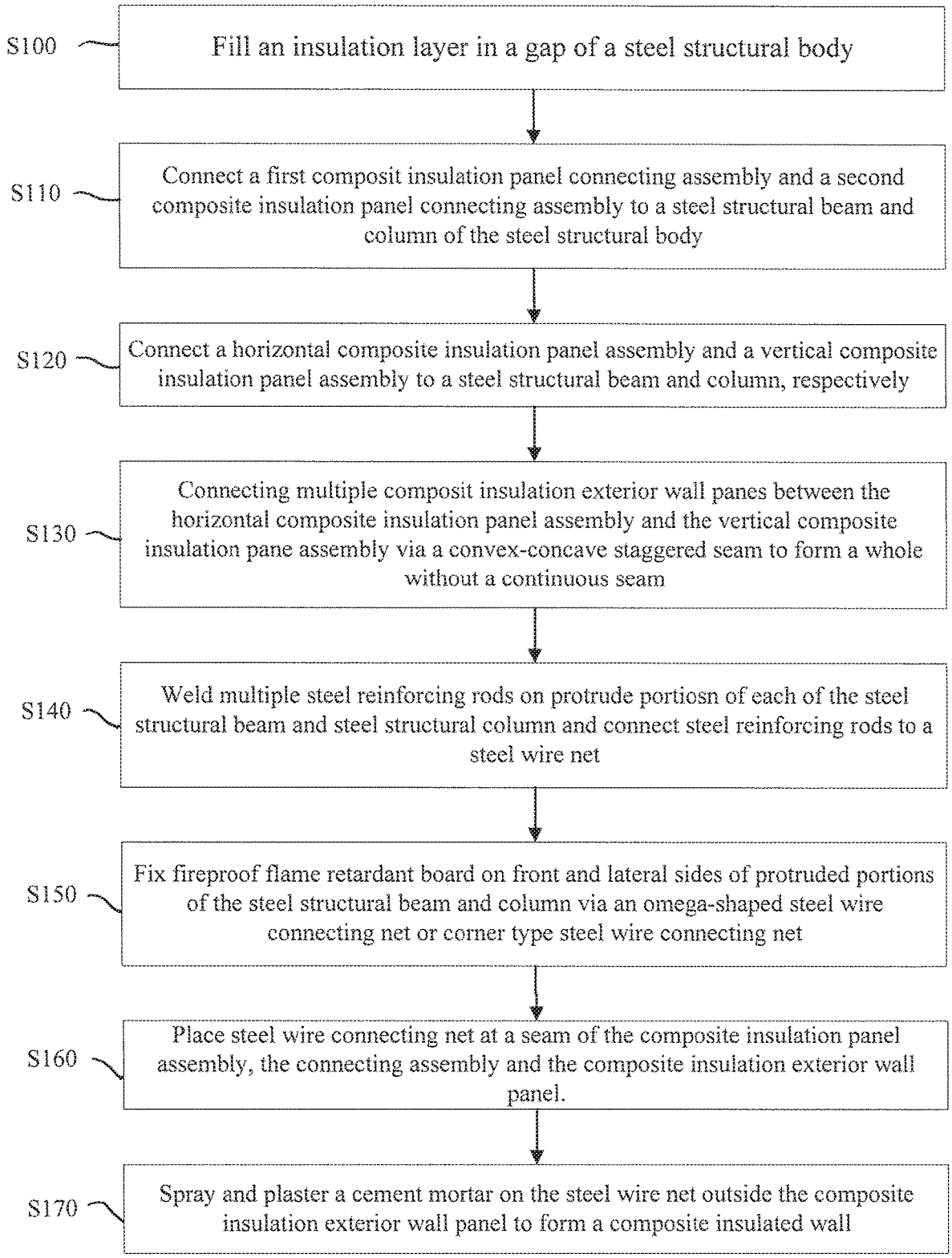
FIG. 9 is a flow chart of the method for connecting a composite insulation exterior wall panel with a steel structural body according to an embodiment of the invention.

Referring to FIG. 9:

1) Fill an insulation layer 6 in a gap of a steel structural body 1 (S100).

2) Connect a first composite insulation panel connecting assembly 2 and a second composite insulation panel connecting assembly 3 to steel structural beam and column (S110).

3) Respectively connect a horizontal composite insulation panel assembly 9 and a vertical composite insulation panel assembly 8 to the steel structural beam and the steel structural column (S120).

4) Connecting multiple composite insulation exterior wall panels 53 between the horizontal composite insulation panel assembly and the vertical composite insulation panel assembly via a convex-concave staggered seam to form a whole without a continuous seam (s130).

5) Respectively weld multiple steel reinforcing rods 11 on two sides of a steel structural body of a protruded portion of each of the steel structural beam and the steel structural column and connect the steel reinforcing rods to a steel wire net (S140).

6) Fix a fireproof flame-retardant board 55 on a front side and a lateral side of the protruded portion of each of the steel structural beam and the steel structural column via an omega-shaped steel wire connecting net 10 or a corner type steel wire connecting net 7, where the steel wire connecting net is disposed on an outer layer of the fireproof board, and is connected to an adjacent steel wire net (S150).

7) Place a steel wire connecting net 12 at a seam of the composite insulation panel assembly, the connecting assembly and the composite insulation exterior wall panel (S160).

8) Spray and plaster a cement mortar on a steel wire net outside the composite insulation exterior wall panel to form a composite insulated wall (S170).

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the invention.

What is claimed is:

1. A structure for connecting a composite insulation exterior wall panel and a steel structural beam-column, comprising a steel structural beam and a steel structural column that together make up a steel structural body having cross-shaped connections and L-shaped connections;

a filling insulation layer is provided at a gap of the steel structural body;

a first composite insulation panel connecting assembly wrapped at a junction between the steel structural beam and the steel structural column when the steel structural beam and the steel structural column are in cross-shaped connection;

a second composite insulation panel connecting assembly wrapped at a junction between the steel structural beam and the steel structural column when the steel structural beam and the steel structural column are in L-shaped connection for corner connection;

a horizontal composite insulation panel assembly connecting the first composite insulation panel connecting assembly and the second composite insulation panel connecting assembly respectively, via a staggered seam, in a horizontal direction, for wrapping the steel structural beam;

a vertical insulation panel assembly connecting the first composite insulation panel connecting assembly and the second composite insulation panel connecting assembly respectively, via a staggered seam, in a vertical direction, for wrapping the steel structural column; and a composite insulation exterior wall panel connected to the horizontal composite insulation panel assembly and the vertical composite insulation panel assembly via a staggered seam to form a whole composite insulation exterior wall panel without a continuous seam.

2. The structure for connecting a composite insulation exterior wall panel and a steel structural beam-column according to claim 1, wherein the first composite insulation panel connecting assembly, the second composite insulation panel connecting assembly, the horizontal composite insulation panel assembly, the vertical composite insulation panel assembly and the composite insulation exterior wall panel respectively comprises a composite insulation panel body, the composite insulation panel body having an insulation panel, a fireproof flame-retardant board and a steel wire net, wherein a layer of the fireproof flame-retardant board is respectively disposed on two sides of the insulation panel, and a layer of the steel wire net is respectively disposed outside the fireproof flame-retardant boards on the two sides.

3. The structure for connecting a composite insulation exterior wall panel and a steel structural beam-column according to claim 2, wherein the steel wire net is fixed outside the fireproof flame-retardant board via a web wire strip, one end of the web wire strip being welded with the steel wire net, and the other end of the web wire strip passing through the fireproof flame-retardant board and is stretched into the insulation panel but not inserted through the insulation panel.

4. The structure for connecting a composite insulation exterior wall panel and a steel structural beam-column according to claim 3, further comprising a non-metallic connecting piece having two ends fixedly connected to the steel wire nets on either side thereof, the non-metallic connecting piece being disposed in the composite insulation panel body and is penetrated through the composite insulation panel body.

5. The structure for connecting a composite insulation exterior wall panel and a steel structural beam-column according to claim 2, wherein:

one side of the insulation panel body of the first composite insulation panel connecting assembly is provided with a cross-shaped groove, close to the junction between the steel structural beam and the steel structural column, the junction between the steel structural beam and the steel structural column is mounted in the cross-shaped groove, and the steel structural beam and the steel structural column are protruded out of the cross-shaped groove;

one side of the insulation panel body of the second composite insulation panel connecting assembly is provided with a T-shaped groove, close to the junction between the steel structural beam and the steel structural column, the junction between the steel structural beam and the steel structural column is mounted in the T-shaped groove, and the steel structural beam and the steel structural column are protruded out of the T-shaped groove;

one side of the insulation panel body of the horizontal composite insulation panel assembly, close to the steel structural beam, is provided with a horizontal groove;

one side of the insulation panel body of the vertical composite insulation panel assembly, close to the steel structural column, is provided with a vertical groove; and the steel structural beam and the steel structural columns are respectively disposed in the horizontal groove and the vertical groove, and are protruded out of the horizontal groove and the vertical groove; and the cross-shaped groove, the T-shaped groove, the horizontal groove and the vertical grooves are located on a same side.

6. The structure for connecting a composite insulation exterior wall panel and a steel structural beam-column according to claim 5, further comprising a steel wire connecting net fixedly connecting the fireproof flame-retardant board on a front side and a lateral side of a protruded portion of each of the steel structural beam and the steel structural column, wherein two sides of the steel wire connecting net are respectively connected a steel wire net outside an adjacent insulation panel body.

7. The structure for connecting a composite insulation exterior wall panel and a steel structural beam-column according to claim 6, further comprising multiple steel reinforcing rods respectively welded on two sides of a steel structural body of the protruded portion of each of the steel structural beam and the steel structural column; and certain ends, far away from the steel structural body, of the steel reinforcing rods are connected to the adjacent steel wire net.

8. The structure for connecting a composite insulation exterior wall panel and a steel structural beam-column according to any one of claim 7, wherein an adjacent junction between the first composite insulation panel connecting assembly, the second composite insulation panel connecting assembly, the horizontal composite insulation panel assembly, the vertical composite insulation panel assembly and the composite insulation exterior wall panel is connected via a staggered seam, the staggered seam connection comprises a protruded portion or a groove notch portion; and a thickness of the protruded portion or the groove notch portion is 2-10 cm.

9. The structure for connecting a composite insulation exterior wall panel and a steel structural beam-column according to claim 2, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

10. The structure for connecting a composite insulation exterior wall panel and a steel structural beam-column according to claim 3, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

11. The structure for connecting a composite insulation exterior wall panel and a steel structural beam-column according to claim 4, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

12. The structure for connecting a composite insulation exterior wall panel and a steel structural beam-column according to claim 5, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

13. The structure for connecting a composite insulation exterior wall panel and a steel structural beam-column according to claim 6, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

14. The structure for connecting a composite insulation exterior wall panel and a steel structural beam-column according to claim 7, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

15. The structure for connecting a composite insulation exterior wall panel and a steel structural beam-column according to claim 8, wherein the insulation panel layer, and the filling insulation layer in the gap of the steel structural body comprises at least one selected from a group consisting of a polystyrene board, a polyurethane board, a graphite polystyrene board and an extruded sheet, and the fireproof flame-retardant board comprises a perlite board and the like.

16. A method for connecting a composite insulation exterior wall panel and a steel structural beam-column, comprising the following steps when a composite insulation panel assembly, a connecting assembly and a composite insulation panel body produced in a factory are transported to a construction site for fabricated assembly:

A) filling an insulation layer in a gap of a steel structural body;

B) connecting a first composite insulation panel connecting assembly and a second composite insulation panel connecting assembly to steel structural beam and column;

C) respectively connecting a horizontal composite insulation panel assembly and a vertical composite insulation panel assembly to the steel structural beam and the steel structural column;

D) connecting multiple composite insulation exterior wall panels between the horizontal composite insulation panel assembly and the vertical composite insulation panel assembly via a convex-concave staggered seam to form a whole without a continuous seam;

E) respectively welding multiple steel reinforcing rods on two sides of a steel structural body of a protruded portion of each of the steel structural beam and the steel structural column and connecting the steel reinforcing rods to a steel wire net;

F) fixing a fireproof flame-retardant board on a front side and a lateral side of the protruded portion of each of the steel structural beam and the steel structural column via a steel wire connecting net, wherein the steel wire connecting net is disposed on an outer layer of the fireproof board, and is connected to a steel wire net outside an adjacent composite insulation panel body;

G) placing a steel wire connecting net at a seam of various composite insulation panel assemblies, the connecting assemblies and the composite insulation exterior wall panels; and H) spraying and plastering a cement mortar on a steel wire net outside the composite insulation exterior wall panel to form a composite insulated wall.

* * * * *